US005450862A

United States Patent [19]

Baldwin et al.

[11] Patent Number: 5,450,862

[45] Date of Patent: Sep. 19, 1995

[54] WRAPPER FOR A SMOKING ARTICLE

[75] Inventors: Sheryl D. Baldwin, Richmond; Gordon H. Bokelman, Chesterfield; Robert N. Ferguson, Richmond; Barton Floyd, Chester; Barbro L. Goodman, Colonial Heights; Robert M. Rogers; Edward B. Sanders, both of Richmond; Susan S. Tafur, Midlothian, all of Va.

[73] Assignee: Philip Morris Incorporated, New York, N.Y.

[21] Appl. No.: 845,738

[22] Filed: Mar. 2, 1992

Related U.S. Application Data

[63] Continuation of Ser. No. 596,526, Oct. 12, 1990, abandoned, which is a continuation-in-part of Ser. No. 429,317, Oct. 31, 1989, abandoned.

[51] Int. Cl.[6] ..... A24D 1/02

[52] U.S. Cl. ..... 131/365

[58] Field of Search ..... 131/365

[56] References Cited

U.S. PATENT DOCUMENTS 2,766,145 10/1956 Jones .
2,886,041 5/1959 Harwood .
2,992,647 7/1961 Figge .
4,108,151 8/1978 Martin et al. .
4,452,259 6/1984 Norman et al. .
4,622,982 11/1986 Gaisch et al. ..... 131/297
4,836,224 6/1989 Lawson et al. ..... 131/365
4,881,557 11/1989 Martin .

FOREIGN PATENT DOCUMENTS 0193607 9/1986 European Pat. Off. .
0231664 8/1987 European Pat. Off. .
0386884 9/1990 European Pat. Off. .
0407022 1/1991 European Pat. Off. .
165982 7/1987 Norway .
1603414 11/1981 United Kingdom .
2209268 5/1989 United Kingdom .

*Primary Examiner*—Jennifer Bahr
*Attorney, Agent, or Firm*—Charles E. B. Glenn; James E. Schardt; Kevin B. Osborne

[57] ABSTRACT

The sidestream smoke associated with a cigarette or cigarette-like smoking article is reduced by wrapping the tobacco in a paper wrapper having an additive, such as an organic acid, an acidic or neutral salt or an organic acid in combination with an acidic salt or neutral salt added thereto.

36 Claims, No Drawings

WRAPPER FOR A SMOKING ARTICLE

This is a continuation of application Ser. No. 596,526, filed Oct. 12, 1990, now abandoned, entitled Wrapper For A Smoking Article which is a continuation-in-part of application Ser. No. 07/429,317 filed on Oct. 31, 1989, now abandoned.

BACKGROUND OF THE INVENTION

The present invention relates to a wrapper construction for use in conjunction with a smoking article, such as a cigarette, that results in the production of reduced amounts of sidestream smoke and a subjectively pleasing taste. More particularly, this invention relates to a paper wrapper for a cigarette having particular additives that yield a reduced amount of sidestream smoke and a subjectively pleasing taste.

With marked changes in the public's attitude and tolerance toward cigarette smoking in recent years, there has been an increased hostility by non-smokers toward smokers. This increased hostility occurs primarily in public places where non-smokers may be exposed to the smoke generated from the cigarettes of smokers. This smoke is generated when the smoker puffs on the cigarette and also when the cigarette is idling between puffs. The smoke generated when the cigarette is idling is known as sidestream smoke. This sidestream smoke contributes nothing to the smoker's enjoyment and may contribute greatly to the discomfort of non-smokers who may be located nearby.

Thus attempts have been made to reduce the sidestream smoke generated by cigarettes. These attempts generally have been directed to modifying the cigarette wrapper or the tobacco filler. For example, Mathews et al. U.S. Pat. No. 4,461,311 discloses the use of "extraordinary amounts" of alkali metal salts on the cigarette wrapper for the reduction of sidestream smoke. A level of at least 6% of the salt is needed to achieve the purported benefits described in that patent. The salts disclosed include sodium and potassium salts of numerous organic and inorganic acids. Similarly, Guess U.S. Pat. No. 4,561,454 discloses the use of high levels (9–20%) of alkali metal salts on one wrapper of a dual-wrapped cigarette for sidestream smoke reduction. The salt of choice disclosed in these two patents is potassium citrate. Hampl et al. Great Britain 2,191,930 discloses a cigarette wrapper having nigh levels (6–12%) of alkali metal salts in combination with a filler of high surface area. This wrapper purportedly reduces sidestream smoke production. Finally, Case et al. Great Britain 2,209,269 discloses the use of high levels of selected burn retardants on the cigarette wrapper in combination with tobacco fillers comprised of at least 20% expanded tobacco to produce cigarettes that generate reduced amounts of sidestream smoke.

The existence of numerous attempts to provide a cigarette that generates a reduced amount of sidestream smoke clearly shows the need in the cigarette industry for such a cigarette. However, none of the prior attempts to provide such a cigarette has been entirely satisfactory and thus none has been successfully developed commercially. The problems with these prior attempts include inadequate sidestream smoke reduction and poor taste characteristics.

It would be desirable to provide a wrapper for a smoking article that results in the production of a reduced amount of sidestream smoke.

It would also be desirable to provide a wrapper for a smoking article that results in the production of a reduced amount of sidestream smoke that does not result in a harsh or unpleasant taste to the smoker.

SUMMARY OF THE INVENTION

It is therefore an object of this invention to provide a wrapper for a smoking article that results in a reduced amount of sidestream smoke.

It is another object of this invention to provide a wrapper for a smoking article that results in the production of a reduced amount of sidestream smoke that does not result in a harsh or unpleasant taste to the smoker.

In accordance with this invention, there is provided a paper wrapper for a smoking article, such as a cigarette, that results in the production of a reduced amount of sidestream smoke and a subjectively pleasing taste. The paper wrapper of this invention has an additive, such as an organic acid, or an acidic salt, or a combination of an acidic or neutral salt and an organic acid, added thereto. In addition, the paper wrapper of this invention may have a high basis weight and a low porosity or may be a standard low basis weight, porous paper. The paper wrapper of this invention may be used for cigarettes of any length or circumference and having different fillers, such as tobacco, expanded tobacco, a variety of tobacco blend types, reconstituted tobacco materials, non-tobacco filler materials and combinations thereof.

When an organic acid is used alone as the additive, between about one half percent by weight and about 12 percent by weight should be used. For maximum reduction of sidestream smoke, the organic acid should be used in conjunction with a high basis weight and a low porosity paper. However, reductions in sidestream smoke may be achieved even with the lower basis weights and higher porosities of conventional cigarette papers.

When an acidic salt is used alone, it should be added in an amount such that between about one half percent by weight and about four percent by weight of the cation is added to the paper. In addition, for maximum reduction of sidestream smoke, the acidic salt should be used in conjunction with a high basis weight and a low porosity paper. However, a standard low basis weight, porous paper can also be used.

When an acidic or neutral salt is used in combination with an organic acid as the additive, a total amount of between about one percent by weight and about 15 percent by weight of the acidic or neutral salt and the organic acid should be added to the paper. A broad range of different ratios of the acidic or neutral salt and organic acid may be used to constitute the additive. The acidic or neutral salt and organic acid combination can be used in conjunction with a high basis weight and a low porosity paper or a standard low basis weight, porous paper.

DETAILED DESCRIPTION OF THE INVENTION

The cigarette with which the paper wrapper of this invention may be used may be of any length or circumference. For example, the circumference of the cigarette may be in the range from about 15 millimeters to about 25 millimeters. In addition, the cigarettes with which the paper wrapper of this invention may be used may contain various fillers such as tobacco, expanded tobacco, a variety of tobacco blend types, reconstituted tobacco materials, non-tobacco filler materials and combinations thereof.

The paper wrappers of this invention may be made from flax or other cellulosic fibers and an inorganic filler, typically calcium carbonate, with a loading of between about 20 percent by weight and about 40 percent by weight, preferably about 30 percent by weight. Other suitable mineral fillers or a combination of fillers may be used. If calcium carbonate is used, the performance of the paper wrapper is enhanced when the surface area of the filler is at least 8 square meters per gram, preferably about 20 square meters per gram.

The additive for the paper wrapper of this invention is an organic acid or an acidic salt or a combination of an acidic or neutral salt and an organic acid.

The acidic nature of the additive is important because this enhances the taste of the smoking article made with paper wrappers of this invention and contributes to reduced amounts of sidestream smoke. Thus the acidic character of the additive should be maintained. For example, the pH of a paper wrapper to which monobasic potassium phosphate has been added is two and one-half pH units less than the pH of a paper wrapper to which tribasic potassium phosphate has been added at equivalent potassium levels.

Although not wishing to be bound by theory, it is believed that the improved taste resulting from the use of an organic acid, an acidic salt or a combination of an acidic or neutral salt and an organic acid is based on the known effect of acidic versus alkaline additives on cellulose pyrolysis. Basic additives cause fragmentation of cellulose into more lower weight compounds including those often considered detrimental to taste, such as aldehydes and carboxyl compounds. Acidic additives lead to less fragmentation with the production of more levoglucosan derived compounds, which are distillable, and anhydrosugars all of which would be expected to have no adverse effect on taste.

The organic acids that may be used include, but are not limited to, the following: succinic, malonic, lactic, levulinic, pimelic, malic, citric, galacturonic, glutaric and adipic. It has been unexpectedly found that the use of organic acids on a paper wrapper not only improves the subjective characteristics of the resulting cigarette but also results in a cigarette that produces reduced amounts of sidestream smoke.

A particular example of a paper wrapper of this invention where an organic acid alone is used as the additive has a basis weight of between about 25 grams per square meter and about 75 grams per square meter, preferably between about 40 grams per square meter and about 70 grams per square meter. An inorganic filler, preferably calcium carbonate having a surface area of at least 8 square meters per gram, preferably about 20 square meters per gram, is used in an amount equal to between about 20 percent by weight and about 40 percent by weight, preferably about 30 percent by weight. The organic acid used should be added to the paper wrapper in an amount equal to between about one half percent by weight and about 12 percent by weight, preferably about 5 percent by weight. The paper wrapper also has a porosity in the range of between about 1 Coresta unit and about 40 Coresta units, preferably between about 1 Coresta unit and about 10 Coresta units and even more preferably between about 3 Coresta units and about 8 Coresta units.

The acidic salts used include acidic salts of inorganic or organic acids including monobasic potassium and sodium salts of polyvalent inorganic acids (such as phosphoric, pyrophosphoric and boric acids) and mono-potassium and sodium salts of organic acids (such as citric, succinic, and fumaric acids). The pH of an aqueous 0.1 molar solution of the acidic salt should be about 5.5 pH units or less. Preferably monobasic potassium phosphate is used as the acidic salt.

Additionally, compounds which are precursors of acidic species can be used as the additive for the paper wrapper of this invention. Compounds which thermally decompose to generate acidic species in situ can produce the desired sidestream smoke reduction combined with acceptable taste. Salts of polyvalent acids with at least one labile proton may produce the desired effect in the presence of heat and water vapor. Various esters, including phosphate esters (such as the potassium salt of α-D-glucose-1-phosphate), which are acidic precursors, may also be used.

Monobasic potassium phosphate is preferred as the acidic salt because of several advantageous characteristics. It has a low melting point to form a stable inorganic liquid. This liquid has been demonstrated by scanning electron microscopy to coat or glaze both the inorganic filler and cellulosic fibers of the paper char. It also dehydrates at 400° C. to form polymeric metaphosphates. Both of these features enhance the ability to form a cohesive ash structure thus promoting sidestream smoke reduction.

When an acidic salt alone is used as the additive, it should be added in an amount such that the amount of the cation added is equal to between about one half percent by weight and about four percent by Weight. The preferred range for the cation depends on which acidic salt is used. Where potassium is the cation, preferably the acidic salt should be added in an amount such that between about 0.5 percent by weight and about 4.0 percent by weight of potassium is added. Where sodium is the cation, preferably the acidic salt should be added in an amount such that between about 0.8 percent by weight and about 2.5 percent by weight of sodium is added. Of course the exact amount of acidic salt to be used will vary depending on the particular acidic salt used.

Combinations of acidic salts, such as monobasic potassium phosphate combined with monobasic potassium citrate, monobasic sodium phosphate, or other salts which will decrease sidestream smoke production in cigarettes may be used as the additive for the paper wrapper of this invention. In addition, combinations of other salts can be used when an aqueous solution of the mixture of salts has a final pH of about 5.5 or less, depending on the particular acid used.

Combinations of salts, at least one of which is acidic or is a precursor of acidic species, can be used to reduce sidestream smoke and to produce an acceptable tasting cigarette. The amounts of acidic salts required depend on the basis weight and porosity of the paper wrapper and can be determined by simple routine experimentation.

A particular example of the paper wrapper of this invention where an acidic salt is used alone as the additive has a basis weight of between about 25 grams per square meter and about 75 grams per square meter. Preferably the basis weight is between about 40 grams per square meter and about 70 grams per square meter. Monobasic potassium phosphate is added to the paper wrapper in an amount equal to between about 4 percent by weight and about 15 percent by weight, preferably about 11 percent by weight. An inorganic filler, preferably calcium carbonate having a surface area of at least 8 square meters per gram, preferably 20 square meters per gram, is used in an amount equal to between about 20 percent by weight and about 40 percent by weight, preferably about 30 percent by weight. The paper wrapper also has a porosity in the range of between about 1 Coresta unit and about 40 Coresta units, preferably between about 1 Coresta unit and about 10 Coresta units and even more preferably between about 3 Coresta units and about 8 Coresta units.

It has also been found that the use of an organic acid in conjunction with an acidic or neutral salt, a precursor of acidic species or combinations thereof as discussed in connection with the use of an acidic salt alone as the additive will provide a cigarette having reduced amounts of sidestream smoke and a subjectively pleasing taste. The use of certain classes of organic acids in conjunction with acidic or neutral salts unexpectedly provides greater sidestream smoke reduction than the use of an acidic salt alone.

When an organic acid is used in conjunction with an acidic or neutral salt, a high basis weight, low porosity paper wrapper or a standard basis weight and standard porosity paper wrapper can be used. A total amount of between about one percent by weight and about 15 percent by weight of the acidic or neutral salt and the organic acid should be added to the paper. A broad range of different ratios of organic acid and acidic or neutral salt may be used to constitute the additive. However, preferably between about one percent by weight and about 13 percent by weight of the acidic or neutral salt, precursor of acidic species or combinations thereof is used and between about one percent by weight and about 8 percent by weight of the organic acid is used.

When using a combination of an acidic or neutral salt and an organic acid, stoichiometric quantities of the materials are utilized such that the additive solution represents an equilibrium mixture of several salt and acid species. Thus, the salt can initially be neutral or acidic. The choice of levels of combinations of salt and organic acid can be varied as desired to achieve the desired sidestream reduction and subjective characteristics.

A particular example of the paper wrapper of this invention where a combination of an acidic or neutral salt and an organic acid is used as the additive has a basis weight of between about 25 grams per square meter and about 75 grams per square meter. Preferably, the basis weight is between about 40 grams per square meter and about 70 grams per square meter. Monobasic potassium phosphate is added to the paper wrapper in an amount equal to between about one percent by weight and about 13 percent by weight. Malonic acid is added to the paper wrapper in an amount equal to between about one percent by weight and about 8 percent by weight, preferably between about 3 percent by weight and about 4 percent by weight. An inorganic filler, preferably calcium carbonate having a surface area of at least 8 square meters per gram, preferably 20 square meters per gram, is used in an amount equal to between about 20 percent by weight and about 40 percent by weight, preferably about 30 percent by weight. The paper wrapper also has a porosity in the range of between about 1 Coresta unit and about 40 Coresta units, preferably between about 1 Coresta unit and about 10 Coresta units and even more preferably between about 3 Coresta units and about 8 Coresta units.

The following examples illustrate the beneficial results of this invention. To measure the amount of sidestream smoke generated, burning cigarettes are allowed to idle while the sidestream smoke travels through a cell through which a light is passed. A photocell detects the transmitted light intensity during the burning of 30 millimeters of the tobacco rod. The measured light intensity is averaged over the course of the burning and compared to the light intensity when no smoke is present in the cell. The value is reported as the extinction coefficient. The tables in the following examples show the extinction coefficients of the test samples or in some cases the percent reduction in visible sidestream smoke as calculated from the extinction coefficient versus a control.

Different instruments for measurement of visible sidestream smoke which accommodate either one or eight cigarettes can be utilized. The two instruments generate different ranges of extinction coefficients which are evident as different values for control samples as shown in the tables of the following examples. In all examples, the control values were generated on the same days that the test samples were analyzed. The relative differences between the extinction coefficients of the control and test samples or the calculated percent reductions show the benefits of this invention.

The control is either a typical 85 or 100 millimeter commercial cigarette having a 25 gram per square meter paper wrapper with a porosity of about 30 Coresta units and a citrate additive. Test cigarettes were made either by hand or on a commercial cigarette maker at comparable packing densities using the same tobacco filler as the control. All test samples were of standard circumference (about 25 millimeters) and 85 millimeters or 100 millimeters in length with a 27 millimeter or 31.5 millimeter cellulose acetate filter. In all of the examples, the test cigarettes were subjectively pleasing.

EXAMPLE 1

All of the paper wrappers in Example 1 were made from paper having 36% calcium carbonate filler with a surface area of 20 square meters per gram. They have a basis weight of 63 grams per square meter and a porosity of between 3.2 Coresta units and 3.7 Coresta units. Table 1 shows the effect of various organic acids on sidestream visibility.

TABLE 1

EFFECT OF ORGANIC ACID AND HIGH BASIS WEIGHT, LOW POROSITY PAPER ON REDUCTION OF VISIBLE SIDESTREAM SMOKE

| PRODUCT | ORGANIC ACID ON PAPER | EXTINCTION COEFFICIENT | % SIDESTREAM REDUCTION |
|---|---|---|---|
| Test Sample 1 | 1.9% succinic acid | 0.45 | 45 |
| Test Sample 2 | 1.3% malonic acid | 0.36 | 56 |
| Control | — | 0.82 | — |

This example clearly shows the effectiveness of organic acid as a paper additive in conjunction with a high basis weight, low porosity paper for the reduction of visible sidestream smoke.

EXAMPLE 2

All of the paper wrappers in Example 2 were made from paper having 30% calcium carbonate filler with a surface area of 22 square meters per gram. They have a basis weight of 63 grams per square meter and a porosity of 2.2–2.3 Coresta units. Table 2 shows the effect of the addition of increasing levels of monobasic potassium phosphate ($KH_2PO_4$) on sidestream visibility.

TABLE 2

EFFECT OF MONOBASIC POTASSIUM PHOSPHATE AND HIGH BASIS WEIGHT, LOW POROSITY PAPER ON REDUCTION OF VISIBLE SIDESTREAM SMOKE

| PRODUCT | % $KH_2PO_4$ ON PAPER | EXTINCTION COEFFICIENT | % SIDESTREAM REDUCTION |
|---|---|---|---|
| Test Sample 3 | 4.0 | 0.46 | 27 |
| Test Sample 4 | 8.5 | 0.35 | 44 |
| Test Sample 5 | 12.3 | 0.18 | 71 |
| Control | — | 0.63 | — |

This example clearly shows the effectiveness of monobasic potassium phosphate as a paper additive for the reduction of visible sidestream smoke. The effect is enhanced in these test samples by the high basis weight of the paper and its low porosity.

EXAMPLE 3

All of the cigarette test samples in Example 3 have paper wrappers with 35% calcium carbonate filler with a surface area of 22 square meters per gram, a basis weight of 45 grams per square meter and a porosity of 5 Coresta units. Cigarettes were prepared from paper wrappers which had different potassium phosphate salts added to the papers as shown in Table 3. The differences in additive levels were made to provide comparable (approximately 3%) potassium levels on each paper.

TABLE 3

COMPARISON OF DIFFERENT POTASSIUM PHOSPHATE SALTS

| PRODUCT | WRAPPER ADDITIVE | % SIDESTREAM REDUCTION | STATIC BURN (min/40 mm rod) |
|---|---|---|---|
| Test Sample 6 | 9.8% $KH_2PO_4$ | 53 | 7.3 |
| Test Sample 7 | 7.3% $K_2HPO_4$ | 44 | 6.0 |
| Test Sample 8 | 5.4% $K_3PO_4$ | 37 | 5.8 |

This example shows the superiority of monobasic potassium phosphate ($KH_2PO_4$) at approximately equivalent potassium content over its di- and tri-potassium forms which are more alkaline.

EXAMPLE 4

All of the paper wrappers in Example 4 were made from paper having 36% calcium carbonate filler with a surface area of 20 square meters per gram. They have a basis weight of 63 grams per square meter and a porosity of about 3 Coresta units. In addition, the papers had about 9% monobasic potassium phosphate ($KH_2PO_4$) contained therein. Table 4 shows the effect of about 4 percent by weight of different organic acids used in conjunction with an acidic salt on visible sidestream smoke. Control A had only about 9% monobasic potassium phosphate added to the paper and Control B was a standard commercial cigarette.

TABLE 4

EFFECT OF USE OF COMBINATION OF AN ORGANIC ACID AND AN ACIDIC SALT AND HIGH BASIS WEIGHT, LOW POROSITY PAPER ON REDUCTION OF VISIBLE SIDESTREAM SMOKE

| PRODUCT | WRAPPER ADDITIVE | EXTINCTION COEFFICIENT |
|---|---|---|
| Test Sample 9 | Pimelic Acid | 0.41 |
| Test Sample 10 | Malonic Acid | 0.23 |
| Test Sample 11 | Succinic Acid | 0.35 |
| Test Sample 12 | Levulinic Acid | 0.52 |
| Test Sample 13 | Malic Acid | 0.33 |
| Test Sample 14 | Galacturonic Acid | 0.32 |
| Control A | — | 0.56 |
| Control B | — | 1.4 |

Example 4 shows the beneficial results of using an acidic salt as compared to a conventional cigarette paper. In addition, Example 4 shows the increased benefit of using a combination of an organic acid and an acidic salt to achieve maximum sidestream smoke reduction.

EXAMPLE 5

All of the paper wrappers in Example 5 were made from paper having 30% calcium carbonate filler with a surface area of about 7 square meters per gram. They have a basis weight of 24 grams per square meter and a porosity of between 15.9 Coresta units and 25.6 Coresta units. In addition the papers had a neutral salt and organic acid added thereto. The levels of additive shown in Table 5 reflect the stoichiometric ratio of materials added. Table 5 shows the effect of the use of an organic acid and neutral salt in combination with a standard low basis weight, porous paper on visible sidestream smoke.

TABLE 5

EFFECT OF USE OF COMBINATION OF AN ORGANIC ACID AND A NEUTRAL SALT AND STANDARD BASIS WEIGHT AND STANDARD POROSITY PAPER ON REDUCTION OF VISIBLE SIDESTREAM SMOKE

| PRODUCT | WRAPPER ADDITIVE | EXTINCTION COEFFICIENT | % SIDESTREAM REDUCTION |
|---|---|---|---|
| Test Sample 15 | 9.7% $K_2$Pimelate ~4.3% Pimelic Acid | 0.40 | 51 |
| Test Sample 16 | 8.8% $K_2$Pimelate | 0.44 | 46 |

TABLE 5-continued

EFFECT OF USE OF COMBINATION OF AN ORGANIC ACID AND A NEUTRAL SALT AND STANDARD BASIS WEIGHT AND STANDARD POROSITY PAPER ON REDUCTION OF VISIBLE SIDESTREAM SMOKE

| PRODUCT | WRAPPER ADDITIVE | EXTINCTION COEFFICIENT | % SIDESTREAM REDUCTION |
|---|---|---|---|
| Test Sample 17 | ~3.9% Pimelic Acid 10% $K_2$ Succinate ~4.5% Succinic Acid | 0.42 | 49 |
| Control | — | 0.82 | — |

EXAMPLE 6

All of the cigarette test samples in Example 6 have paper wrappers with 30% calcium carbonate filler with a surface area of about 7 square meters per gram, a basis weight of 25 grams per square meter, and a porosity of about 20 to 30 Coresta units. Table 6 compares the effect of acid versus neutral salts on a conventional commercial paper.

TABLE 6

COMPARISON OF EFFECTS OF ACIDIC VERSUS NEUTRAL SALTS ON STANDARD BASIS WEIGHT, STANDARD POROSITY PAPERS

| PRODUCT | WRAPPER ADDITIVE | % K | % SIDESTREAM REDUCTION |
|---|---|---|---|
| Test Sample 18 | 9.1% $K_2$ pimelate | 3.0 | 15 |
| Test Sample 19 | 11.2% KHpimelate | 2.2 | 44 |
| Test Sample 20 | 8.8% $K_2$malonate | 3.8 | + |
| Test Sample 21 | 10.5% KHmalonate | 2.9 | 29 |

Acidic salts are clearly more effective than neutral salts. The better performance is also achieved at lower % potassium levels on the paper. These test samples show that acidic salts can be used to reduce sidestream on conventional commercial cigarette wrappers.

EXAMPLE 7

All of the cigarette test samples in Example 7 have paper wrappers with 36% calcium carbonate filler with a surface area of 22 square meters per gram, a basis weight of 63 grams per square meter, and different levels of acidic potassium salts of pimelic or malonic acid. Table 7 shows the effectiveness of acidic organic salts on high basis weight, low porosity papers.

TABLE 7

EFFECTS OF ACIDIC POTASSIUM SALTS OF ORGANIC ACIDS ON HIGH BASIS WEIGHT, LOW POROSITY PAPER

| PRODUCT | WRAPPER ADDITIVE | % K | CORESTA POROSITY | EXTINCTION COEFFICIENT | SBT | % SIDESTREAM REDUCTION |
|---|---|---|---|---|---|---|
| Test Sample 22 | 9.1% KHpimelate | 1.8 | 2.2 | 0.15 | 10.2 | 80.5 |
| Test Sample 23 | 5.6% KHpimelate | 1.1 | 3.2 | 0.28 | 8.1 | 64 |
| Test Sample 24 | 3.0% KHpimelate | 0.6 | 3.9 | 0.38 | 8.5 | 51 |
| Test Sample 25 | 10.2% KHmalonate | 2.8 | 4.9 | 0.26 | 7.8 | 66 |
| Test Sample 26 | 6.2% KHmalonate | 1.7 | 4.8 | 0.45 | 6.9 | 42 |
| Test Sample 27 | 3.3% KHmalonate | 0.9 | 4.7 | 0.47 | 7.2 | 39 |
| Control | — | — | — | 0.77 | — | — |

In Example 7, it is evident that the use of an acidic organic salt on a high basis weight, low porosity paper can achieve excellent sidestream smoke reduction without the need of a high potassium level. The test samples in Example 7 also demonstrate that differences among acid salts can be expected. The acidic potassium pimelate salt reduces the porosity of the paper and produces a longer static burn time (SBT) both of which contribute to its greater effectiveness for sidestream smoke reduction than the malonate salt. Such differences in performance due to the additive can be exploited to provide products with the most desirable characteristics.

EXAMPLE 8

All of the cigarette test samples in Example 8 have paper wrappers with 35% calcium carbonate filler with a surface area of 22 square meters per gram, a basis weight of 45 grams per square meter, and different levels of acidic potassium salts of pimelic or malonic acid. Table 8 shows the effectiveness of acidic organic salts on medium basis weight, low porosity papers.

TABLE 8

EFFECTS OF ACIDIC POTASSIUM SALTS OF ORGANIC ACIDS ON MEDIUM BASIS WEIGHT, LOW POROSITY PAPER

| PRODUCT | WRAPPER ADDITIVE | % K | CORESTA POROSITY | EXTINCTION COEFFICIENT | SBT | % SIDESTREAM REDUCTION |
|---|---|---|---|---|---|---|
| Test Sample 28 | 9.1% KHpimelate | 1.8 | 3.6 | 0.26 | 9.7 | 66 |
| Test Sample 29 | 6.1% KHpimelate | 1.2 | 4.4 | 0.32 | 9.0 | 58 |
| Test Sample 30 | 3.6% KHpimelate | 0.7 | 5.7 | 0.44 | 8.8 | 43 |
| Test Sample 31 | 12.0% KHmalonate | 3.3 | 8.0 | 0.44 | 7.3 | 43 |
| Test Sample 32 | 6.9% KHmalonate | 1.9 | 8.0 | 0.48 | 7.0 | 38 |
| Test Sample 33 | 3.6% KHmalonate | 1.0 | 7.1 | 0.52 | 7.8 | 32 |

TABLE 8-continued

| EFFECTS OF ACIDIC POTASSIUM SALTS OF ORGANIC ACIDS ON MEDIUM BASIS WEIGHT, LOW POROSITY PAPER | | | | | | |
|---|---|---|---|---|---|---|
| PRODUCT | WRAPPER ADDITIVE | % K | CORESTA POROSITY | EXTINCTION COEFFICIENT | SBT | % SIDESTREAM REDUCTION |
| Control | — | — | — | 0.77 | — | — |

As with high basis weight papers (see Example 7), acidic organic salts show good sidestream smoke reduction on medium basis weight papers.

EXAMPLE 9

The cigarette test samples in Example 9 have paper wrappers with 36% calcium filler with a surface area of 22 square meters per gram and a basis weight of 63 grams per square meter. In addition, the papers have about 9% $KH_2PO_4$ and 4% malonic acid contained therein. Table 9 compares the effects of different tobacco blends in this wrapper on sidestream smoke reduction.

TABLE 9

| COMPARISON OF EFFECTS OF DIFFERENT TOBACCO BLENDS ON SIDESTREAM SMOKE REDUCTION | | | | | |
|---|---|---|---|---|---|
| PRODUCT | TOBACCO FILLER | FILLER WEIGHT (mg) | EXTINCTION COEFFICIENT | SBT | % SIDESTREAM REDUCTION |
| Test Sample 34 | Normal Blend | 800 | 0.24 | 9.6 | 71 |
| Test Sample 35 | 52% Expanded Blend | 550 | 0.19 | 7.6 | 77 |
| Control | Normal Blend | 800 | 0.82 | 8.3 | — |

The test samples in Example 9 show that the sidestream smoke reduction achieved with paper wrappers of this invention are equally effective on cigarette products with typical blended tobacco fillers or other blended fillers with a high expanded component content. Tobacco fillers can be modified as is well known to those skilled in the art to produce cigarettes with the most desirable burn properties.

EXAMPLE 10

The paper wrappers in Example 10 have a basis weight of 25 grams per square meter and a porosity greater than about 20 Coresta units. The papers have about 5% pimelic or malonic acid added thereto. Table 10 shows the effect of the use of an organic acid as the only additive on a typical commercial paper.

TABLE 10

| EFFECT OF ORGANIC ACID ON STANDARD BASIS WEIGHT AND STANDARD POROSITY PAPER ON REDUCTION OF VISIBLE SIDESTREAM SMOKE | | | |
|---|---|---|---|
| PRODUCT | WRAPPER ADDITIVE | EXTINCTION COEFFICIENT | % SIDESTREAM REDUCTION |
| Test Sample 36 | Pimelic Acid | 1.23 | 13 |
| Test Sample 37 | Malonic Acid | 1.17 | 17 |
| Control | — | 1.41 | — |

The test samples of Example 10 show the benefits of using an organic acid in combination with a standard basis weight and standard porosity paper. As can be seen by a comparison with Example 1, the use of organic acid on a high basis weight, low porosity paper is preferred to achieve maximum reduction of sidestream smoke. In addition, a comparison of this example with Example 5 shows that the use of a combination of an organic acid and a salt on a standard basis weight and standard porosity paper is preferred to achieve maximum sidestream smoke reduction.

The observation of the superiority of acidic additives for the reduction of sidestream smoke represents a clear departure from past teachings. The prior art does not suggest the use of acidic additives for reducing sidestream smoke and does not differentiate among mono-, di-, or tribasic salts of inorganic or organic acids. Acidic additives are considered unique because they act by a mechanism different from those proposed previously for sidestream smoke reduction. The importance of this difference has not been recognized by those skilled in the art of developing cigarettes which produce reduced amounts of sidestream smoke. In addition, the acidic character of the additive also results in a cigarette that is clearly preferable in terms of taste over cigarettes having wrappers with more alkaline salts added thereto.

Thus it is seen that a paper wrapper for a cigarette is provided that results in reduced amounts of sidestream smoke but does not result in a harsh or unpleasant taste to the smoker. One skilled in the art will appreciate that the present invention can be practiced by other than the described embodiments, which are presented for purposes of illustration and not of limitation, and the present invention is limited only by the claims that follow.

What is claimed is:

1. A paper wrapper for a smoking article comprising a cellulosic base web, a filler loading and between about 4 percent by weight and about 15 percent by weight of an acidic salt selected from the group consisting of monobasic potassium salts of polyvalent inorganic acids and organic acids and wherein the cation of said acidic salt comprises between about 0.5 percent by weight and about 4.0 percent by weight of said paper wrapper.

2. A paper wrapper for a smoking article comprising a cellulosic base web, a filler loading and between about 4 percent by weight and about 15 percent by weight of an acidic salt selected from the group consisting of monobasic sodium salts of polyvalent inorganic acids and organic acids and wherein the cation of said acidic salt comprises between about 0.8 percent by weight and about 2.5 percent by weight of said paper wrapper.

3. A paper wrapper for a smoking article comprising a cellulosic base web, a filler loading and an acidic salt which gives a pH of about 5.5 or less for an aqueous 0.1 molar solution.

4. A paper wrapper for a smoking article comprising a cellulosic base web, a filler loading and a combination of two or more salts which gives a pH of about 5.5 or less for an aqueous 0.1 molar solution.

5. The paper wrapper of any of claims 1, 2, 3 or 4 having a basis weight of between about 25 grams per square meter and about 75 grams per square meter, a porosity of between about one Coresta unit and about 40 Coresta units and a filler loading of between about 20 percent by weight and about 40 percent by weight.

6. The paper wrapper of claim 5 having a basis weight of between about 40 grams per square meter and about 70 grams per square meter, a filler loading of about 30 percent by weight and a porosity of between about one Coresta unit and about 10 Coresta units.

7. A paper wrapper for a smoking article having a basis weight of between about 25 grams per square meter and about 75 grams per square meter, a filler loading of between about 20 percent by weight and about 40 percent by weight, a porosity of between about 1 Coresta unit and about 40 Coresta units and between about one percent by weight and about 15 percent by weight of a combination of an organic acid and another additive selected from the group consisting of an acidic salt, a neutral salt, an acid precursor which decomposes thermally to generate acidic species in situ as said smoking article is smoked, the salt of a polyvalent acid with at least one labile proton.

8. The paper wrapper of claim 7 wherein the organic acid is selected from the group consisting of succinic acid, malonic acid, lactic acid, levulinic acid, pimelic acid, malic acid, citric acid, galacturonic acid, glutaric acid, adipic acid and combinations thereof.

9. A paper wrapper for a smoking article comprising a cellulosic base web, a filler loading and between about one percent by weight and about 15 percent by weight of a combination of an acidic salt or a neutral salt and an organic acid, wherein said acidic salt or neutral salt comprises a metal cation, wherein said acidic salt is monobasic potassium phosphate.

10. A paper wrapper for a smoking article comprising a cellulosic base web a filler loading and between about one percent by weight and about 15 percent by weight of a combination of an acidic salt or a neutral salt and an organic acid, wherein said acidic salt or neutral salt comprises a metal cation and said acidic salt gives a pH of about 5.5 or less for an aqueous 0.1 molar solution.

11. The paper wrapper of claim 10 wherein said acidic salt is a combination of two or more salts which give a pH of about 5.5 or less for an aqueous 0.1 molar solution.

12. A paper wrapper for a smoking article comprising a cellulosic base web, a filler loading and between about one percent by weight and about 15 percent by weight of a combination of an acidic salt or a neutral salt and an organic acid, wherein said acidic salt or neutral salt comprises a metal cation, wherein said acidic salt is selected from the group consisting of monobasic sodium salts of polyvalent inorganic acids and organic acids.

13. The paper wrapper of claim 12 wherein the cation of said acidic salt comprises between about 0.5 and about 4.0 percent by weight of said paper wrapper.

14. The paper wrapper of claim 12 wherein the cation of said acidic salt comprises between about 0.8 and about 2.5 percent by weight of said paper wrapper.

15. The paper wrapper of any of claims 9, 10, 11, 13, or 14 wherein the organic acid is selected from the group consisting of succinic acid, malonic acid, lactic acid, levulinic acid, pimelic acid, malic acid, citric acid, galacturonic acid, glutaric acid and combinations thereof.

16. The paper wrapper of claim 15 having a basis weight of between about 40 grams per square meter and about 70 grams per square meter, a filler loading of about 30 percent by weight and a porosity of between about one Coresta unit and about 10 Coresta units.

17. A paper wrapper for a smoking article comprising a cellulosic base web, a filler loading, between about one percent by weight and about 13 percent by weight of an acid precursor which decomposes thermally to generate acidic species in situ as said smoking article is smoked and between about one percent by weight and about 8 percent by weight of an organic acid.

18. A paper wrapper for a smoking article comprising a cellulosic base web, a filler loading, between about one percent by weight and about 13 percent by weight of the salt of a polyvalent acid with at least one labile proton and between about one percent by weight and about 8 percent by weight of an organic acid.

19. A paper wrapper for a smoking article comprising a cellulosic base web, a filler loading, between about one percent by weight and about 13 percent by weight of a combination of two or more additives at least one of which is acidic or a precursor of acidic species and between about one percent by weight and about 8 percent by weight of an organic acid.

20. The paper wrapper of any of claims 17, 18 or 19 wherein the organic acid is selected from the group consisting of succinic acid, malonic acid, lactic acid, levulinic acid, pimelic acid, malic acid, citric acid, galacturonic acid, glutaric acid, adipic acid and combinations thereof.

21. The paper wrapper of claim 20 having a basis weight of between about 40 grams per square meter and about 70 grams per square meter, a filler loading of about 30 percent by weight and a porosity of between about one Coresta unit and about 10 Coresta units.

22. A smoking article comprising smoking material overwrapped by a paper wrapper having a cellulosic base web, a filler loading and between about one percent by weight and about 15 percent by weight of a combination of an acidic salt or a neutral salt and an organic acid.

23. A smoking article comprising smoking material overwrapped by a paper wrapper having a cellulosic base web, a filler loading and between about 4 percent by weight and about 15 percent by weight of an acidic salt.

24. A smoking article comprising smoking material overwrapped by a paper wrapper having a cellulosic base web, a filler loading and between about one percent by weight and about 13 percent by weight of an acidic salt or neutral salt and between about one percent by weight and about 8 percent by weight of an organic acid.

25. The smoking article of claims 22, 23, or 24 wherein said smoking material is formed from material selected from the group consisting of tobacco, expanded tobacco, reconstituted tobacco materials, non-tobacco smoking material and combinations thereof.

26. The smoking article of claim 25 wherein said paper wrapper has a basis weight of between about 40 grams per square meter and about 70 grams per square meter, a filler loading of 30 percent by weight and a porosity of between about one Coresta unit and about 10 Coresta units.

27. A paper wrapper for a smoking article comprising a cellulosic base web, a basis weight of between about 35 grams per square meter and about 65 grams per square meter, a porosity of between about 3 Coresta units and about 20 Coresta units, a calcium carbonate filler loading of between about 20 percent by weight and about 40 percent by weight, and a monobasic potassium phosphate additive level of between about 7 percent by weight and about 14 percent by weight.

28. The paper wrapper of claim 27 wherein the basis weight is between about 40 grams per square meter and about 60 grams per square meter, the porosity is between about 8 Coresta units and about 15 Coresta units, the calcium carbonate filler loading is between about 25 percent by weight and about 35 percent by weight, and the monobasic potassium phosphate additive level is between about 8.5 percent by weight and about 13 percent by weight.

29. The paper wrapper of claim 27 wherein the basis weight is between about 42 grams per square meter and about 57 grams per square meter.

30. The paper wrapper of claim 27 wherein the basis weight is about 47.5 grams per square meter, the porosity is between about 11 Coresta units and about 12 Coresta units, the calcium carbonate filler loading is about 33 percent by weight, and the monobasic potassium phosphate additive level is about 10.5 percent by weight.

31. A smoking article comprising smoking material overwrapped by a paper wrapper having a cellulosic base web, a basis weight of between about 35 grams per square meter and about 65 grams per square meter, a porosity of between about 3 Coresta units and about 20 Coresta units, a calcium carbonate filler loading of between about 20 percent by weight and about 40 percent by weight, and a monobasic potassium phosphate additive level of between about 7 percent by weight and about 14 percent by weight.

32. The smoking article of claim 31 wherein said paper wrapper has a basis weight of between about 40 grams per square meter and about 60 grams per square meter, a porosity of between about 8 Coresta units and about 15 Coresta units, a calcium carbonate filler loading of between about 25 percent by weight and about 35 percent by weight, and a monobasic potassium phosphate additive level of between about 8.5 percent by weight and about 13 percent by weight.

33. The smoking article of claim 32 wherein said paper wrapper has a basis weight of between about 42 grams per square meter and about 57 grams per square meter.

34. The smoking article of claim 31 wherein said paper wrapper has a basis weight of about 47.5 grams per square meter, a porosity of between about 11 Coresta units and about 12 Coresta units, a calcium carbonate filler loading of about 33 percent by weight, and a monobasic potassium phosphate additive level of about 10.5 percent by weight.

35. A paper wrapper for a smoking article comprising a cellulosic base web, a basis weight of about 25 grams per square meter, a porosity of between about 20 Coresta units and about 30 Coresta units, a calcium carbonate filler loading of about 30 percent by weight, and between about one half percent by weight and about 12 percent by weight of an acidic salt, wherein said acidic salt comprises a metal cation.

36. A smoking article comprising smoking material overwrapped by a paper wrapper having a cellulosic base web, a basis weight of about 25 grams per square meter, a porosity of between about 20 Coresta units and about 30 Coresta units, a calcium carbonate filler loading of about 30 percent by weight, and between about one half percent by weight and about 12 percent by weight of an acidic salt, wherein said acidic salt comprises a metal cation.

* * * * *